US005139206A

United States Patent [19]

Butler

[11] Patent Number: 5,139,206

[45] Date of Patent: Aug. 18, 1992

[54] WIRE PREFEEDER

[75] Inventor: John D. Butler, Germantown, Wis.

[73] Assignee: Mechtrix Corporation, Menomonee Falls, Wis.

[21] Appl. No.: 662,771

[22] Filed: Feb. 28, 1991

[51] Int. Cl.[5] ..... B65H 59/38; B65H 51/30

[52] U.S. Cl. ..... 242/45; 226/42; 226/44; 226/118; 226/183; 226/187; 242/129.51; 254/405; 254/411

[58] Field of Search ..... 242/45, 25 R; 226/42, 226/43, 24, 44, 183, 118, 119, 186, 187; 254/403, 405, 411, 333

[56] References Cited

U.S. PATENT DOCUMENTS

| | | | |
|---|---|---|---|
| 2,305,318 | 12/1942 | Pfleider | 254/405 X |
| 2,741,437 | 4/1956 | Haworth | 242/45 |
| 2,825,512 | 3/1958 | Andren | 242/45 |
| 2,912,099 | 11/1959 | Brouse et al. | 226/183 X |
| 3,413,834 | 12/1968 | Kovaleski | 242/25 R X |

*Primary Examiner*—Stanley N. Gilreath

*Attorney, Agent, or Firm*—Fuller, Ryan, Hohenfeldt & Kees

[57] ABSTRACT

A wire prefeeder has a tower standing on a base. A horizontal upper shaft is mounted fixedly to the upper end of the tower and a plurality of pulleys are on the shaft. A carriage is adapted to in the tower and another horizontal lower shaft which has a plurality of pulleys and is mounted to the carriage in parallelism with the upper shaft. A wire infeed device is driven with an electric motor. Wire feeds to a dancer pulley after which it is looped around the upper and lower pulleys in succession and departs tangentially from a pulley on its way to a wire processing machine which draws the wire. The carriage rises when there is an instantaneous increase in wire tension and an electric signal is produced whose magnitude corresponds to the amount of carriage movement. The motor responds to the signal by changing the motor and wire infeed speed to pay out wire at a rate which keeps the tension in the drawn wire constant. A new type of clamp is provided for coupling a wire reel to a shaft. A unique retainer is provided for preventing the wire from springing off of the pulleys.

6 Claims, 7 Drawing Sheets

WIRE PREFEEDER

BACKGROUND OF THE INVENTION

A variety of electrical wire processing machines are used in industry for automatically cutting insulated wire into pieces of uniform length and for stripping the insulation off the ends of the wire segments. Wire processing machines typically demand wire at rates of 1 to 6 meters per second. At these demand rates, it is virtually impossible to pull wire directly off of a reel fast enough. Moreover, many wire processing machines do not have very great gripping power nor pulling ability on the wire so the force of pulling wire directly off of a reel results in wire length inconsistency and stripped length inconsistency. The excessive pulling force necessary to rotate the reel results in the wire slipping in the processing machine's feeding system and sometimes results in the wire stretching and breaking. All of the problems that arise as a result of not prefeeding wire to the processing machine with constant tension in the wire become greater when very small gauge wire is being processed. Small gauge wires are easily stretched and broken when very little tension force is developed in them.

SUMMARY OF THE INVENTION

The invention disclosed herein fulfills the need for a wire prefeeding system which can supply wire faster than the demand by the wire processing machine and maintain a constant tension in the wire which is below the drawing or pulling capability of the processing machine and below the tensile force in the wire which would break it.

Briefly stated, one embodiment of the new wire prefeeder system comprises a base on which there is a support for bearings which journal a horizontally extending shaft on which the reel, from which wire is to be drawn, is clamped. A variable speed electric motor, which may be characterized as a servomotor, is mechanically coupled to the shaft for driving it rotationally. The system includes an electrical controller which responds to a change in the magnitude of a control signal, indicative of changes in wire tension, by increasing or decreasing the motor speed and, hence, the rate at which wire is paid out from the reel.

There is a tower mounted on the base in juxtaposition to the reel. A non-rotating upper shaft whose axis is parallel to the axis of the reel shaft extends horizontally from the upper part of the tower. A plurality of coaxial peripherally grooved pulleys are arranged for rotating freely on the upper shaft. The tower is provided with vertical guide members for guiding a carriage which can move from a lowermost position below the upper pulleys towards the upper pulleys and back toward a lowermost or lower limit position again in correspondence with changes in the draw rate of the wire. The movable carriage has a non-rotating horizontal lower shaft fixed in it in parallelism with the upper shaft. The lower shaft also has a corresponding plurality of pulleys mounted on it for free rotation. Mounted on the base intermediate the tower and reel is a dancer pulley guide means. The dancer pulley can move up on guide members from a resting position near the base to an upper limit set by a stop at the upper end of the guide means. The threading pattern for the wire involves passing the wire leading from the reel around the bottom of the dancer pulley and then up to one of the uppermost pulleys on the tower. After that the wire is looped or threaded from an upper pulley to a lower pulley back to the upper pulley and a lower pulley, and so forth, until the free end of the wire leading out to the wire processing machine extends tangentially from one of the lower pulleys.

When the processing machine is drawing wire at a minimal rate, the carriage on which the lower set of pulleys are mounted simply remains in its lowermost or rest position. When the draw rate increases, the tendency is for increased tension to develop in the wire. The increased tension causes the lower carriage to yield upwardly so as to quickly pay out some of the wire that is stored in the wire loops extending between the upper and lower pulley sets so excessive tension cannot occur. As soon as the carriage with the lower set of pulleys on it begins to move upwardly the electric motor controller is signalled to cause the motor to drive the reel at a higher rate which keeps the tension in the wire fed to the wire processing machine constant. The higher the lower pulley carriage rises the greater is the change in the magnitude of the electric control signal and the greater is the speed at which the motor and, hence, the reel is driven which results in the amount of wire being stored between the upper and lower pulley sets being increased toward the maximum amount and the tension increase in the wire is nullified instantaneously. Conversely, a drop in the draw rate results in the reel drive motor slowing down and in the carriage descending toward its lower limit.

Wire is supplied by wire manufacturers in at least three different ways. The most common way is on a spool or reel. Three spools or reels are obtainable in a variety of axial widths, diameters, and bore sizes. They can range from a few pounds to hundreds of pounds. Light weight reels, such as reels weighing 35 pounds or less can be lifted easily and placed on the reel shaft or spindle even when the prefeeder is standing on a table top of conventional height. It is better, however, for heavier reels to be mounted closer to the floor for feeding wire to minimize lifting effort to the extent possible.

Another common way for wire to be supplied is in a barrel in which the wire is coiled. When used as a source of wire for the prefeeder, the wire is fed out of the barrel through a guide eyelet or ring which is secured in a position above the barrel coincident with the axis of the barrel.

Another not so common way for wire to be supplied is in the form of coil. Sometimes wire ties or tape is applied to keep the wire coils organized.

According to the invention, means are provided which adapt the prefeeder for using as a source of wire light weight, small or large diameter reels or spools, or a barrel, or an open coil or a heavy reel mounted on a floor stand.

The general features of the new prefeeder which were just discussed and other important features will now be described in greater detail in reference to the preferred embodiment of the invention which is depicted in the accompanying drawings.

DESCRIPTION OF A PREFERRED EMBODIMENT

Figure 1:
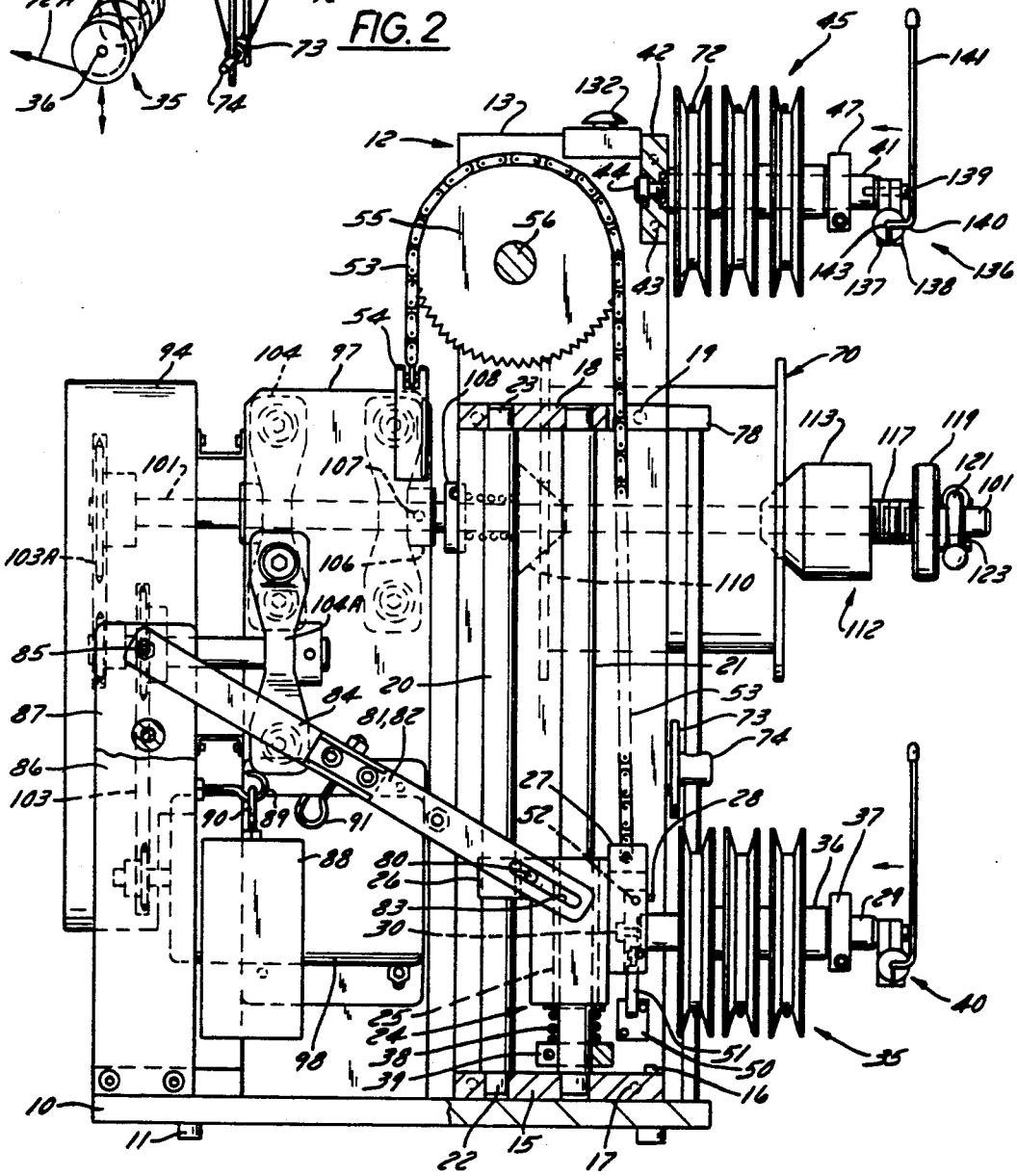
FIG. 1 is a side elevational view of the new wire prefeeder.

Attention is invited to FIG. 1 which shows that the prefeeder system is mounted on a base plate 10 having cylindrical rubber feet 11 extending from its bottom. A tower, designated generally by the reference numeral 12 is mounted to the base plate 10. The tower includes two upstanding side plates one of which is visible in FIG. 1 and is marked 13. The other side plate 14 is shown fragmentarily in FIG. 4 and is arranged in parallel with mating side plate 13. Referring to FIG. 1 again, shown at the bottom of the drawing is a horizontal bed plate 15 which spans between the lower ends of the side plates 13 and 14 and is fastened to the base plate 10 by means of four socket headed machine screws 16. The side plates 13 and 14 of the tower are fastened to bed plate 15 by screws which are not visible in FIG. 1 but which are threaded into holes such as the one marked 17. There is another horizontal plate 18, which is also visible in FIG. 3, at a level substantially above the bed plate 15. Plate 18 also spans across the space between side plates 13 and 14 of the tower and ties into the side plates by means of screws which would thread into holes such as the one marked 19 after having passed through the side plates 13 and 14. The two spaced apart parallel side plates 13 and 14, the bed plate 15 and the plate 18 which spans between the side plates form what may be called a tower assembly.

Figure 3:
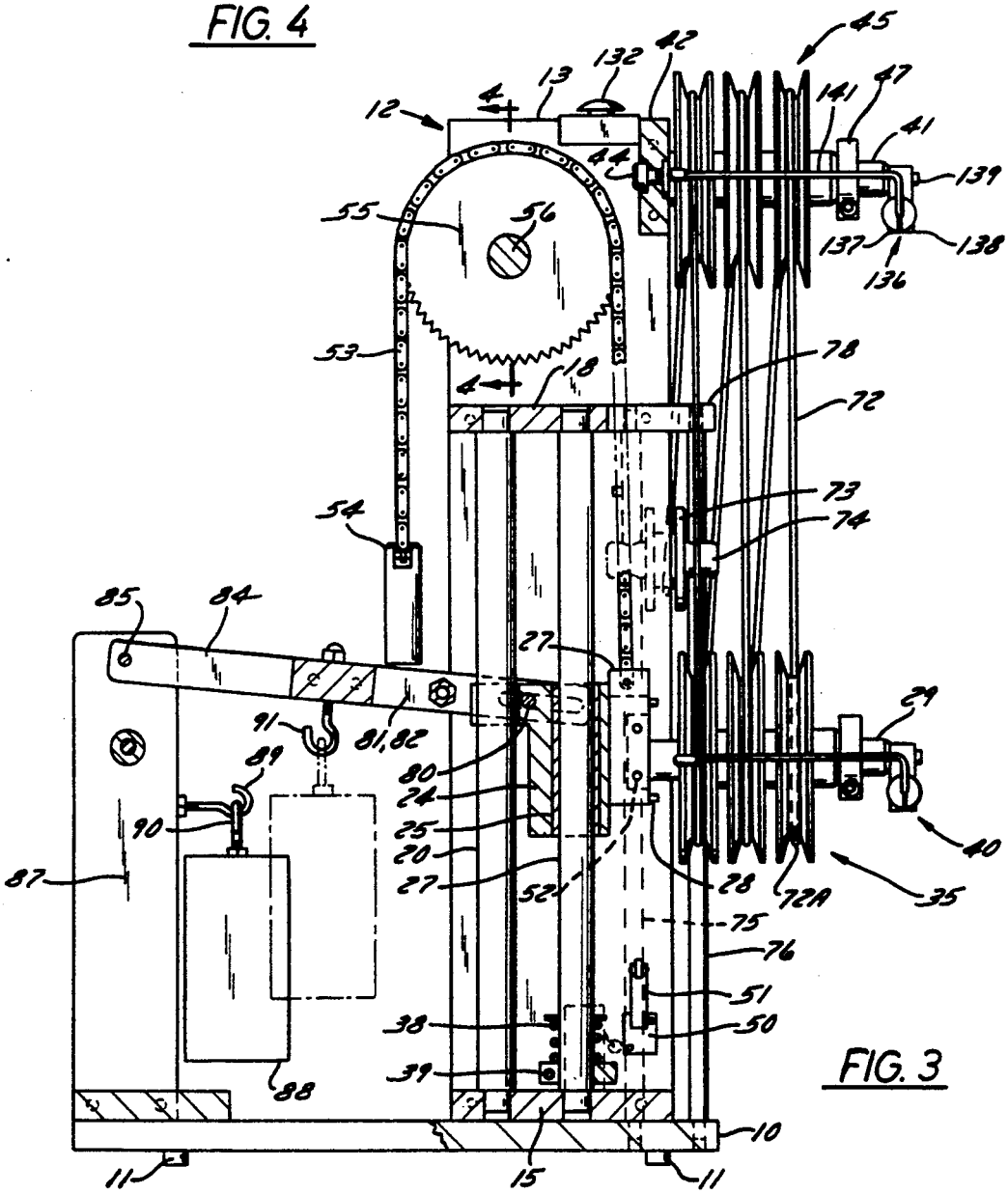
FIG. 3 is similar to FIG. 1, with some parts omitted, wherein the lower carriage and the lower pulley set thereon are in an elevated position.

Referring to FIGS. 1 and 3 particularly, vertical guide means in the form of parallel rods 20 and 21 extend between bed plate 15 and the upper cross plate 18. The lower ends of the rods fit into holes such as the one marked 22 in bed plate 15 and the holes such as the one marked 23 in the cross plate 18.

There is a carriage 24 which has a suitable bushing 25 for allowing the carriage to slide up and down on guide rod 21. In FIG. 1 the carriage 24 is presently at its lowermost or resting position. In FIG. 3 the carriage is in an intermediate elevated position. The carriage has a lateral extension 26 which is simply notched so it can slide along vertical guide rod 20 concurrently with the main body of the carriage sliding along the other guide rod 21. The notched lateral portion 26, by fitting rather closely to the guide rod 20, contributes toward preventing the carriage 24 from turning on rod 21 during vertical translational movements of the carriage.

A shaft support in the form of a block 27 is fastened to carriage 24 by means of machine screws 28. The end of a horizontally extending shaft 29 is fastened in block 27 by means of a machine screw 30 which is shown in hidden lines. Shaft 29 is called the lower shaft. There is a lower pulley set 35 comprised of three grooved pulleys which rotate freely on shaft 29. They are spaced apart axially by integral axially extending hubs such as the hub marked 36. A clamping collar 37 retains the pulleys on lower shaft 29. There is a shock absorber spring 38 concentric to the lower end of the vertical guide rod 21 for carriage 24. Spring 38 rests on a collar 39 which is clamped onto vertical guide rod 21.

Still referring to FIG. 1, a non-rotating stationary horizontal shaft 41 is mounted to the tower 12 near its top. Shaft 41 is called the upper shaft. A mounting block for the shaft 41 is a cross member 42 which spans between side plates 13 and 14 of the tower 12 and is secured to the side plates by means of machine screws, not shown, which screw into threaded holes such as the one marked 43. A bolt 44 has its threaded body passing through block 42 and has its threaded end turned into the end of shaft 41 so as to secure the shaft to the block 42. There are a plurality of coaxially arranged upper pulleys, such as the one marked 45 mounted for rotating freely on stationary upper shaft 41. As shown in FIG. 1, the upper set of pulleys 45 are in vertical alignment with the lower set of pulleys 35 and the axes of lower pulley shaft 36 and upper pulley shaft 41 are parallel and, in this particular embodiment, are in vertical alignment with each other. Pulleys 45 are retained on upper shaft 41 by means of a collar 47 which can be tightened to the shaft.

Still referring to FIG. 1, there is a switch 50 mounted to the rearmost side plate 13 of the tower next to the carriage 24 when the carriage is in its lowermost position. The switch has an operating arm 51. A cam 52, shown in dashed lines, is mounted to the backside of shaft supporting block 27. Assuming that switch 50 is a normally open switch as it is in this embodiment, it will be held open by reason of cam 52 pressing against operating arm 51 when the carriage 24 is in its lowermost position wherein it is resting on shock absorber spring 38. When carriage 24 moves just a short distance upwardly on guide rod 21, the roller of the switch operating arm 51 departs from the cam 52 and the switch is allowed to change to a closed circuit state with consequences that will be discussed later.

Figure 4:
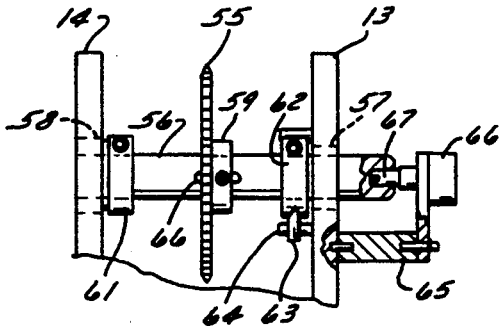
FIG. 4 is a fragmentary sectional view taken on a line corresponding to 4—4 in FIG. 3, this view showing a timing chain sprocket, a shaft, and a potentiometer driven by the shaft.
Figure 7:
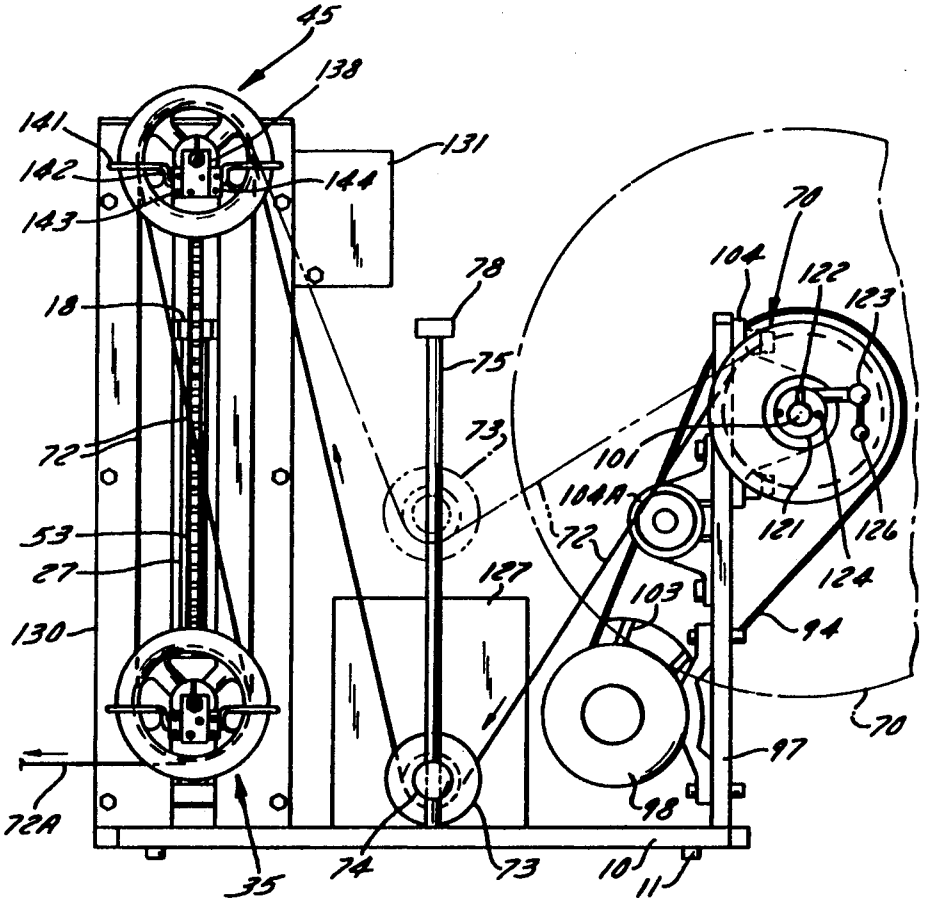
FIG. 7 is a side elevational view of the prefeeder in operation with the guard shroud installed.

One end of a flexible element such as roll chain 53, depicted in FIGS. 1, 3 and 7, for example, is fastened to the carriage 24 by being engaged with lower shaft 29 supporting block 27. A counterweight 54 for the carriage 24 is fastened to the other end of the chain 53 and serves to hold the chain in engagement with the teeth of an idler means in the form of a sprocket 55. Sprocket 55 is fastened to a shaft 56 which appears in cross-section in FIGS. 1 and 3 and in elevation in FIG. 4 to which attention is now invited. As shown in FIG. 4 there are bushings 57 and 58 in side plates 13 and 14, respectively, of the tower. Sprocket shaft 56 turns in these bushings. The sprocket 55 has a hub 59 to provide for fastening the sprocket to shaft 56 by any suitable means such as by using the keyway 60. A collar 61 is clamped to shaft 56 for preventing it from shifting to the left in FIG. 4 and there is another collar 62 clamped to the shaft for preventing it from shifting to the right. Collar 62, which rotates with shaft 56, has a stop pin 63 extending radially from it. There are two fixed stop pins, one of which is marked 64 as is illustrated in FIG. 4. The stop pins 64 extend from side plate 13 of the tower and the stop pin 63 on collar swings between them. They set the maximum angle through which the shaft 56 can turn in either direction. A bracket 65 is mounted to side plate 13 of the tower. A potentiometer body 66 is fastened to the bracket and the rotatable stem 67 of the potentiometer extends into the end of shaft 56 so that when the shaft 56 turns, in response to vertical movements of carriage 24, the potentiometer shaft 67 also turns and this results in the potentiometer producing a signal whose magnitude corresponds to the amount which the sprocket 55 and its shaft 56 turns. Thus, the signal produced by potentiometer 66 is directly proportional to the level or present elevation of the carriage 24, and is indirectly proportional to the tension existing at any instant in the wire 72A being drawn off of one of the lower pulleys as shown in FIG. 2.

Figure 9:
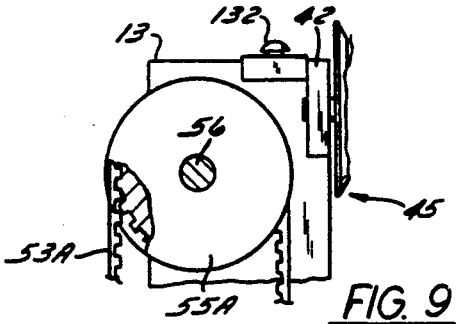
FIG. 9 is related conceptually to FIG. 4 in that FIG. 9 illustrates driving the potentiometer with a toothed timing belt as one alternative of a chain for maintaining a linear relationship between the position of the lower carriage used in the prefeeder and the rotational angle of the potentiometer.

FIG. 9 shows a flexible element in the form of a toothed timing belt 53A engaged with a toothed pulley 55A for driving the potentiometer 66 and assuring maintenance of the precise correlation between the elevation of carriage 24 and the potentiometer 66 and the magnitude of the analog signal produced by the potentiometer which corresponds to the position of carriage 24. The toothed belt 53A and pulley 55A can be used in place of chain 53 and sprocket 55, respectively.

Figure 2:
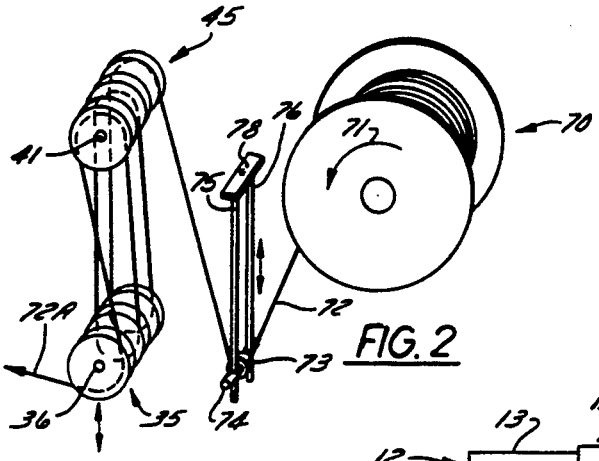
FIG. 2 is a diagram for facilitating explaining how the wire dispensed from a reel or other source of wire is threaded or looped through the pulleys of the prefeeder.

The FIG. 2 diagram shows the course of the wire through the prefeeder. Wire which is to be processed originates, in this of several possible arrangements, at a wire infeed reel 70 which is mounted on a spindle, not shown in FIG. 2, and is adapted for being driven rotationally in the direction of the arrow 71. Wire 72 comes off the reel and passes on the bottom side of peripherally grooved dancer pulley 73 which rotates freely on a vertically slidable horizontal shaft 74. Shaft 74 has two holes through it to allow it to slide up and down onto stationary vertical dancer guide shafts 75 and 76. There is a stop member 78 fastened across the ends of shafts 75 and 76. The dancer assembly and its function will be described in greater detail later.

After the wire 72 passes under dancer pulley 73, the wire runs up to one of the pulleys in the upper pulley set 45. The pulleys 45 turn freely on shaft 41 which is fixed to the upper part of the tower 12 as previously explained. The wire loops or threads around pulleys in the upper set 45 and the lower pulley set 35 and finally the wire 72A leading to a wire processing machine, not shown, leaves one of the lower pulleys tangentially. As previously explained, the lower pulley set 35 turns freely on a lower shaft 29 which is mounted to carriage 24 in FIG. 1 so the lower pulley set will rise and descend in response to variations in tension on the wire 72A caused by the unillustrated wire processor. It will be evident from the mechanical advantage of the cooperating lower and upper pulley sets 35 and 45 that a very small increase in the tension of outgoing wire 72A will raise the lower pulley set and thereby permit wire which is actually stored by way of the loops between upper and lower pulley sets 45 and 35 to pay out rapidly from the lower pulley to minimize the tension change in outgoing wire 72A. The manner in which the reel 70 is driven rotationally to quickly replace the length of wire stored in the loops between the upper and lower pulley sets while at the same time feeding wire out at a rate which maintains tension in the outgoing wire 72A constant will be discussed in greater detail later.

FIG. 3 shows the wire 72 threaded over and around the lower and upper pulley sets 35 and 45. Insulated wires which have a small diameter and are flexible will be stretched straight in the distance between the upper and lower pulley sets. The stiffness of large diameter wires, possibly having stiffer insulation, may result in the wire spans between the pulley sets bulging out because of the memory of the wire for the circularity it had when it was still on the infeed reel 70. To prevent this, means are provided for, in effect, adding to the weight of carriage 24 so as to develop the gravitational force which will tend to straighten the wire lengths in the loops spanning between the upper and lower pulley sets to reduce or eliminate the bulging. The mechanism for doing this is easily perceived by viewing FIGS. 1 and 3. In FIG. 1 there are two pins, a visible one of which, 80, extends laterally from carriage 24. One leg 81 of a fork can be visualized in this figure and there is a corresponding leg 82 behind it. The legs have elongated slots, such as the one marked 83 near their outer ends and pin 80, for example, extends through the slot 83. The fork is connected to a lever 84 which is fastened to a pivot pin 85. The lever 84 is arranged between an upstanding post 86 in the foreground and another post 87 in the background. The pivot pin 85 is journaled for rotation in the posts. When rather flexible wire is being processed by the infeeder there is no need to do anything about bulging of the wire between the pulley sets because no bulging exists. Thus, the lever comprised of fork 81, 82 and lever 84 simply rides along with the carriage 24 without adding substantial weight to the carriage.

A supplemental weight 88 is stored on a hook 89 which is mounted to the posts 86, 87 as shown. When bulging of the wire spanning between the upper and lower pulley sets 45 and 35 is to be reduced or eliminated, the eye-bolt 90 is unhooked from hook 89 and then hooked onto an eye-bolt 91 on the lever 84. This, in effect, increases the gravitational force on the carriage 24 and causes the stiffer wires spanning between the upper and lower pulley sets 45 and 35 to stretch straight or nearly straight. In FIG. 3, the supplemental weight 88 is depicted in phantom lines where it is hooked onto hook 91. This figure revels why bars 81 and 82 are spaced apart from each other in the manner of a fork since this provides a space for the counterweight 54 on the end of the flexible member in the form of a chain 53 to move up and down without striking the lever.

Figure 6:
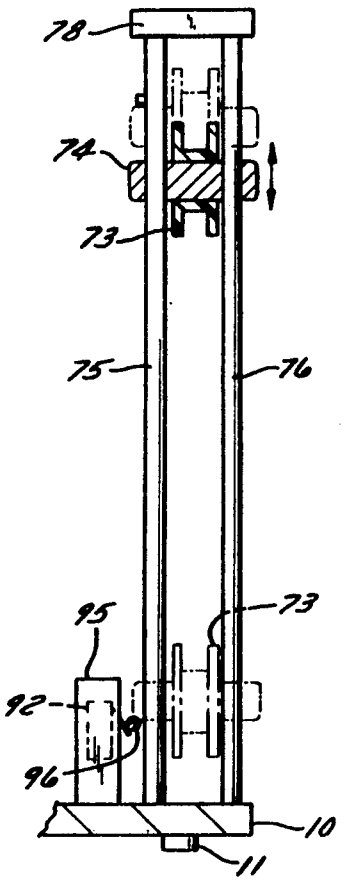
FIG. 6 is an isolated view of a dancer assembly.

The dancer pulley arrangement which was mentioned briefly in connection with the FIG. 2 diagram is shown in greater detail and realistically in FIGS. 6 and 7 to which attention is now invited. The dancer pulley 73 and the carrier shaft 74 were previously identified. FIG. 6 shows that the guide means in the form of rods 74 and 76 are mounted to the prefeeder base 10. The pulley 73 is depicted in phantom lines in its lower limit position in FIG. 6. A switch sown in hidden lines marked 92 is contained in a guard box marked 95. The switch has an operating lever terminating in a roller 96 extending from box 95. The switch can be considered normally open and is being held open by the phantom line representation of the dancer carrier shaft 74 pressing against the roller 96. As soon as the dancer pulley 73 begins to rise above its lower limit position, the switch 92 in guard box 95 is actuated to a closed circuit condition. As will be clarified later, the dancer pulley controlled switch in box 95 and the limit switch 50 at the bottom of the tower in FIG. 1, for example, which is switched to a closed circuit condition when the carriage 24 starts to move upward, must both be in closed circuit condition to energize the motor 98 for starting to drive the reel 70 rotationally at a speed which increases in proportion to the amount by which the carriage 24 is elevated above its lower limit position.

The wire infeed reel 70 and the components for supporting and driving it rotationally will now be discussed in reference to FIGS. 5 and 7. A column in the form of a plate 97 is mounted to base 10 of the prefeeder. An electric motor 98 is mounted to the column 97. There is a sprocket 99 on the motor shaft and a sprocket 100 on the end of a shaft or spindle 101 on which the wire dispensing reel 70 is clamped. Motor 98 drives reel shaft 101 rotationally by means of a drive system which includes motor sprocket 99, idler shaft 102, chain loops 103 and 103A and sprockets on the shafts. The chain drive is concealed in a guard or shroud 94. Reel shaft 101 is journaled in bearing blocks such as the one marked 104 which are bolted to column 97 by means of machine bolts such as the one indicated by the numeral 105. Shaft 101 is secured against end play or axial movement by way of collars, such as the one marked 106, which are held to the reel shaft 101 by means of set screws such as the one marked 107. Idler shaft 102 is journaled in a bearing block 104A.

Figure 5:
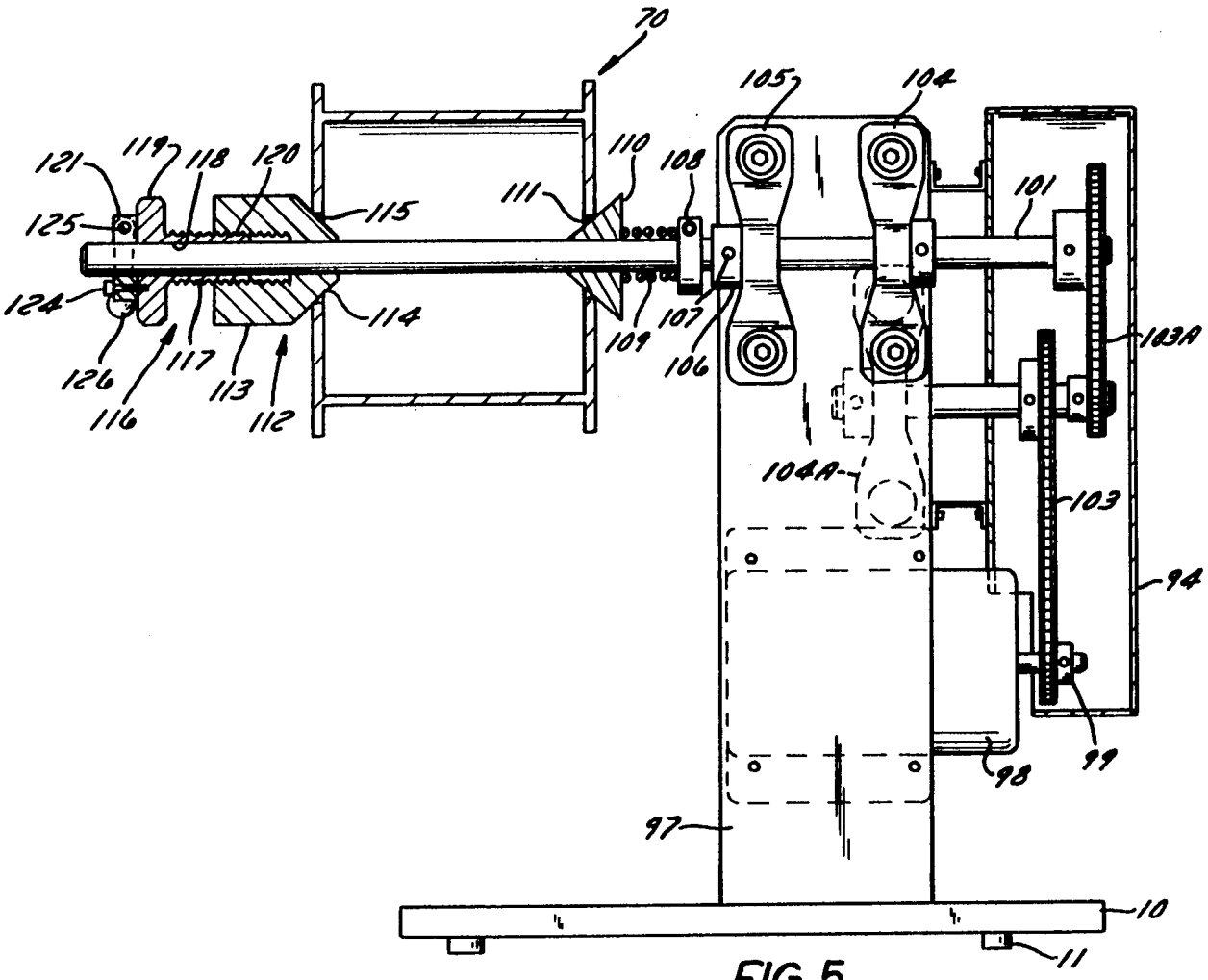
FIG. 5 is front elevational view of an empty wire reel and the motor and mechanism for driving the reel rotationally.

As is clearly shown in FIG. 5, wire dispensing reel 70 is clamped to the reel shaft 101 in a unique way to facilitate easy and quick removal and replacement of a reel in accordance with the invention. A collar 108 is clamped to shaft 101 and there is a coil compression spring 109 on the shaft which reacts against collar 108. A conical element 110 is slidable on shaft 101. The base of the conical element reacts against spring 109. The apex end of the conical element fits into the bore 111 in one end of reel 70. The new means for clamping reel 70 to shaft 101 includes an element 112 which is called an adjustment cone. It has a cylindrical part 113 whose periphery is preferably knurled. It also has a conical part 114 whose apex end is pressed into the hole 115 in the end of reel 70 to effect frictional clamping of the reel 70 to shaft 101. A specialized cone screw 116 having an external thread 117 and an internal bore 118 fits slidably on reel shaft 101. The cone screw includes an integral knurled hand grippable disk or wheel 119. It is evident in FIG. 5 that the cylindrical part 113 of the adjustment cone 112 has an internal thread 120 for receiving the thread 117 of the cone screw. A generally circular collar 121 with a gap 122 in it (see FIG. 7) is designed for being clamped to shaft 101 and being unclamped therefrom. Collar 121 is secured to the knurled disk 119 of cone screw 116 by machine screws 124. The collar 121 has a clamping screw 125 spanning across the gap 122. As is visible in FIGS. 1, 5 and 7 there is a crank handle 123 on the threaded clamping screw 125 which when turned in one direction squeezes or clamps the collar 121 to shaft 101. For quickly clamping a reel 70 to shaft 101, first the adjustment cone 112 together with the cone screw 116 and the attached collar 121 are removed from shaft 101. The reel 70 is then slid over shaft 101 to permit spring biased cone element 110 to enter hole 111 in one end of the reel. The adjustment cone 112 with the adjustment screw thread 117 turned into it even further than it is in FIG. 5 is then slid over the shaft so the conical part 114 of the adjustment cone enters hole 115 in the reel. Collar 121 is then tightened or clamped to shaft 101 which prevents cone screw 116 from turning on shaft 101. Then the disk 119 is gripped by one hand and the other hand turns the knurled adjustment cone 112 in a direction which tends to back it off of the cone screw thread 117 in the adjustment cone. This causes the adjustment cone conical portion 114 to be driven forcibly into hole 115 in the end of reel 70. Concurrently, the reel is driven against the sliding cone 111 such that the total clamping force is established by and limited by the expansive force developed in compression spring 109. With this clamping system, a reel 70 can be removed from reel drive shaft 101 and a replacement reel can be clamped on the shaft easily in less than a minute.

Figure 16:
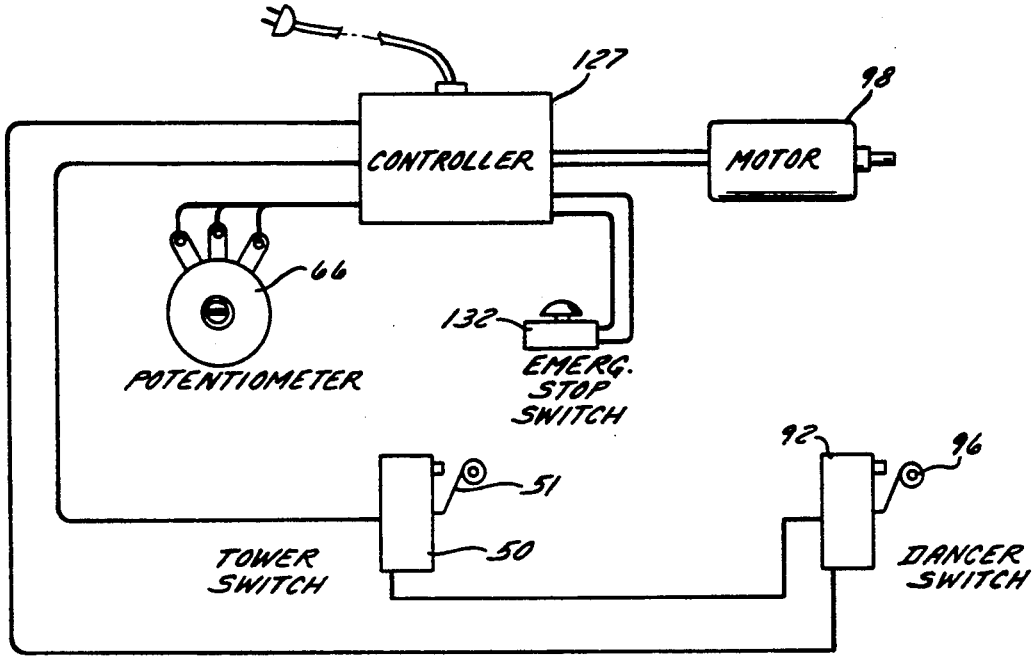
FIG. 16 is a circuit diagram pertaining to the new prefeeder.
Figure 15:
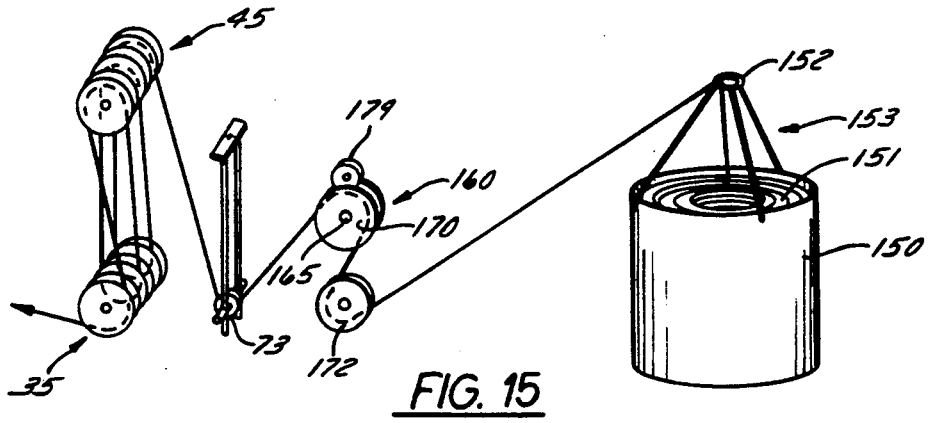
FIG. 15 is a diagrammatic view of an embodiment of a wire infeed device for use with the prefeeder wherein the source of wire is a barrel which stands on the floor.
Figure 14:
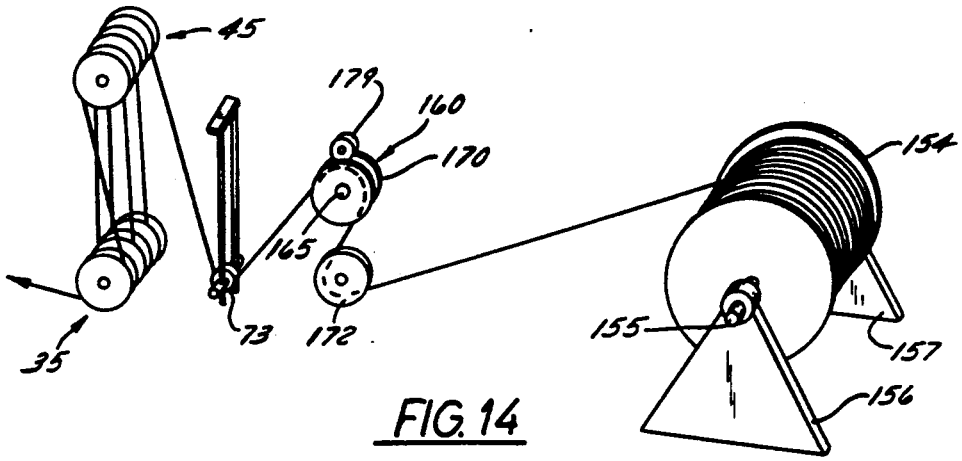
FIG. 14 is a diagrammatic view of an embodiment of a wire infeed device for use with the prefeeder wherein the source of wire is a large reel supported on a floor stand.

FIG. 7 illustrates, mounted on base 10, a commercially available motor controller represented by the rectangle 127 for controlling the speed of reel driving motor 98 in relation to the position of carriage 24. The wiring diagram is shown in FIG. 16 which shows how the carriage limit switch 50 in the tower and the dancer switch are connected in series so both must be closed to signal the controller to start motor 98 for imparting rotational force to the reel shaft 101. The circuitry includes the potentiometer 66 which produces the analog signal which is representative of the level to which the carriage 24 is elevated as it is in FIG. 3. There is a plug-in type power cord leading to the controller 127 and there is another output cord leading from the controller to motor 98.

FIG. 7 shows the prefeeder set up for operation. A guard or housing 130 is now fitted over the mechanism in the tower 12 for several reasons including giving the prefeeder a pleasant aesthetic quality. A side housing extension 131 covers the potentiometer 66 and its mounting brackets 65 which are depicted in FIG. 4.

Referring to FIG. 7, it can be assumed that wire 62A is being drawn from the prefeeder by a wire processing machine, which is not shown but which, for example, may be a commercially available type dedicated to cut wire into desirably accurate uniform lengths and to strip the insulation from the ends of the wire lengths. When drawing wire 72A at the start, the initial tension in drawn wire 72A will cause the lower and upper pulley sets 35 and 45 to turn freely on their shafts and the tension in the single wire 72A being drawn is subdivided among the plurality of wire lengths or loops that extend between the lower and upper sets of pulleys 35 and 45 and this minor tension is propagated to the wire portion 72 leading off the reel such that the tension in the wire between the reel and the first pulley in the upper set of pulleys 45 is sufficient for elevating the dancer pulley 73 which is on sliding carrier shaft 74. The carrier shaft for the dancer pulley can rise until it reaches the stop 78 which spans across the ends of vertical guide rods 75 and 76. As soon as there is enough tension in drawn wire 72A to start elevating the carriage 24 and the lower set of pulleys 45 thereon, the limit switch 51 or tower switch at the foot of the tower will close to complete a series circuit which includes the limit switch 95 operated by the dancer pulley shaft. Limit switch 95 would also now be closed. As tension tends to increase in the wire, the stored amount of wire, which is in the form of the loops running from the upper to the lower sets of pulleys 34 and 35, is paid out as drawn wire 72A. However, as the carriage 24 rises it drives the potentiometer 66 by way of the flexible element in the form of chain 53 or timing belt 53A so the potentiometer produces an analog signal representative of the level to which the carriage 24 and the lower set of pulleys 35 is raised. The higher it is raised, the faster motor 98 will turn which means that the reel 70 will turn at a higher rate with the result that wire will be fed from the reel 70 at a rate which will tend to restore the amount of wire that is stored between the upper and lower sets of pulleys 45 and 35 while at the same time the tension established in outgoing wire 72A is no greater than is required to lift carriage 24 and whatever is appended to it. Thus, the tension force in the wire is held constant.

Figure 8:
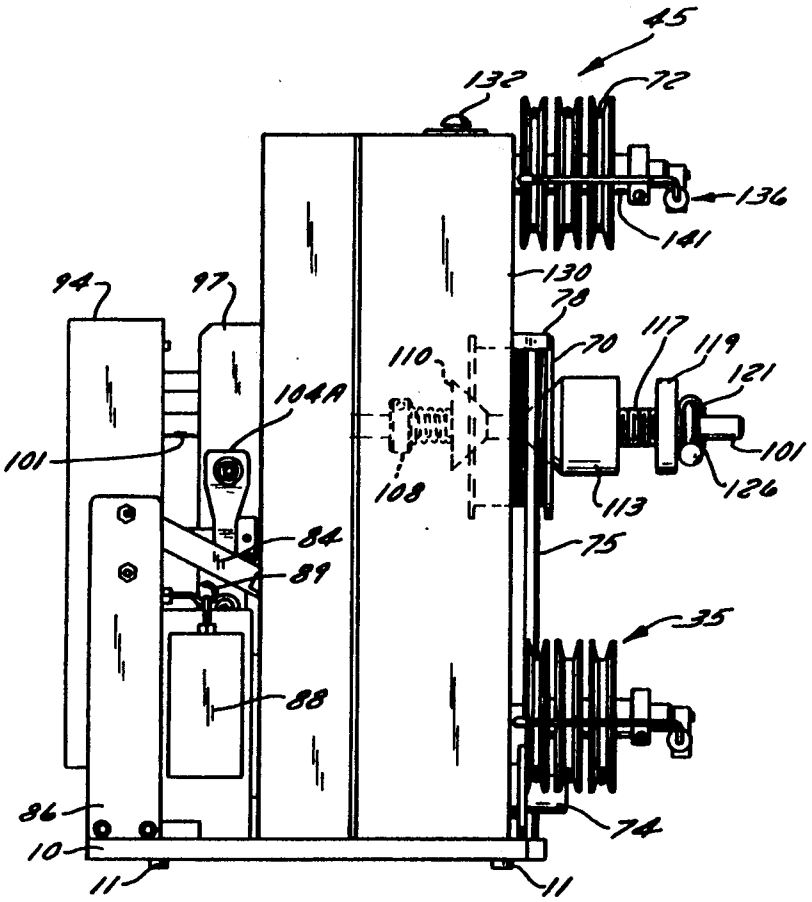
FIG. 8 is a front elevational view of the prefeeder which, as in FIG. 7, has the guard walls installed to conceal the mechanism in the tower.
Figure 10:
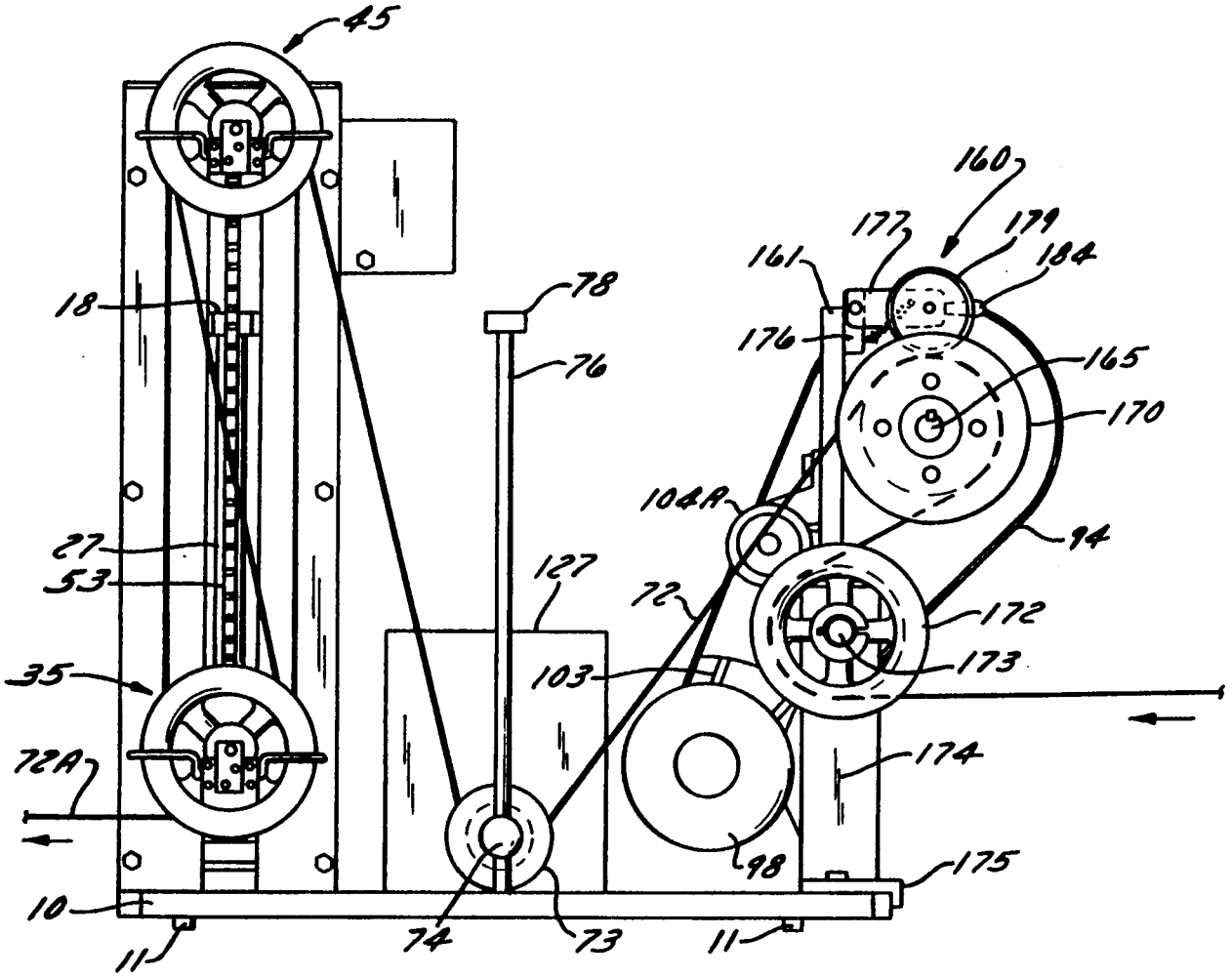
FIG. 10 shows a front elevational view of apparatus for adapting the prefeeder to use wire stored in a barrel or on a reel supported on a floor stand, for example, as a source of wire.

A side elevational view of the assembled prefeeder is depicted in FIG. 8 which is presented primarily for clarifying the arrangement of some of the parts of the prefeeder. Thus, the motor mounting column 97 can be seen as can the lever 84 to which the supplemental weight 88 is optionally attached. The supplemental weight 88 is presently in storage and is hanging on its storage hook 89. The foreground post 86, on which lever 84 is mounted in conjunction with background post 87, is visible in FIG. 8 also. There is a button 132 at the top of the mechanism guard 130 which provides for manually operating an emergency stop switch which is symbolized by a rectangle in the FIG. 16 wiring diagram. When the motor is stopped while feeding wire out, there is a little bit of reel overtravel which, instead of resulting in a snarl of wire is simply taken up or placed under small tension by the weight of the dancer pulley 73 and its shaft 74. This also assures that the wire will not spring off of the dancer pulley.

Another feature of the new prefeeder resides in the means for retaining the wire against unwrapping or springing off of the upper and lower sets of pulleys 45 and 35, especially when the wire is stiff and is inclined to bulge out between the upper and lower pulley sets 45 and 35. Similar retaining means 40 and 136 are used in conjunction with the lower and upper sets of pulleys 35 and 45 so only typical retaining means 136 will be described. Referring to the upper right region of FIG. 1, the wire retaining means 136 comprises two interfacing blocks of metal 137 and 138. They are secured together and to the end of upper pulley shaft 141 by means of a machine screw 139. A generally U-shaped wire retainer rod 140 has opposite end portions or arms such as the one marked 141, which are spaced apart by an amount just slightly greater than the diameter of the pulleys 45 in FIG. 1, for example. In FIG. 1 the arms 141 are vertical and swung away from the sides of the pulleys 45 to allow threading wire 72 around the pulleys whereas in FIGS. 3 and 7 the arms are swung alongside of the pulleys for retaining the wire. As can be seen in FIG. 7 arms 141 are connected together by means of a portion of the wire retainer rod in which there is an offset 142 which results in a straight portion that can pass through a pair of mating grooves, not visible, which are in the interfacing blocks 137, 138 and form a bore in which the offset portion 142 of the rod is journaled. As shown in FIG. 7, there are clamping collars 143 and 144 on opposite sides of the blocks which prevent the rods from shifting laterally so that the arms 141 lie closely to the periphery of the pulleys 45 when the arms are swung to a horizontal position as depicted in FIGS. 3, 7 and 8.

Figure 11:
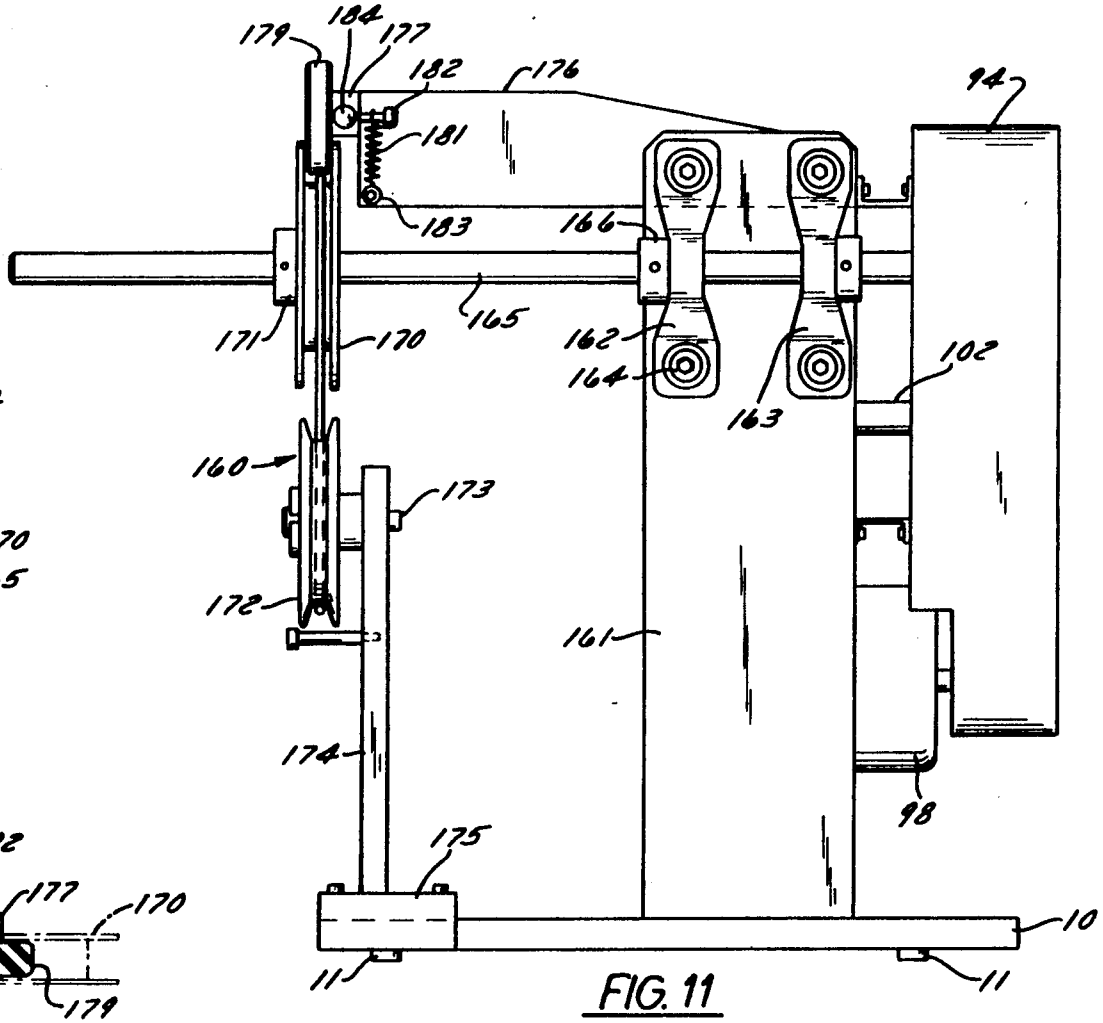
FIG. 11 is an elevational view of the adaptation apparatus looking at the right angle of FIG. 10.
Figure 12:
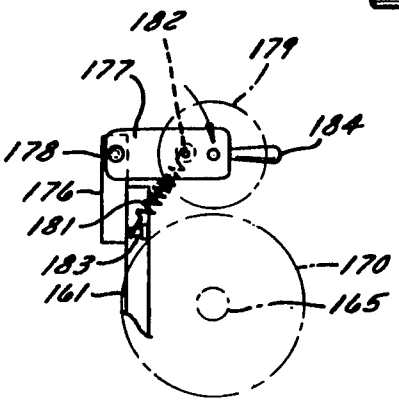
FIG. 12 is a fragmentary view of a wire restraining subassembly which is used in the FIGS. 10 and 11 apparatus.

As mentioned earlier, there are occasions where the source of wire which the prefeeder draws from is not always a light weight reel which can be easily lifted to the height of a table on which the prefeeder is mounted and installed on the reel shaft 101. Instead, the quantity of wire may be so large that it will be necessary to handle it with a hoist which can set it on a floor proximate to the new prefeeder. For example, in FIG. 15, the source of wire is a barrel such as the one marked 150 in FIG. 15. Here the coil of wire 151 is set concentrically in barrel 150 and the wire is fed out to the prefeeder through a guide ring 152 which stands on a tripod 153 which is mounted on the barrel as shown. Another source of wire is the large and heavy reel 154 which is mounted on a shaft 155 and the shaft is journaled on the legs 156 and 157 of a floor stand. In cases where the reel cannot be mounted on the reel shaft 101 as is the situation in FIGS. 14 and 15, there is a special adaptation of the electric motor drive system for the previously discussed system depicted in FIG. 5, for example. The alternative wire infeed drive system is depicted in FIGS. 10–15. Attention is invited to FIGS. 10 and 11 wherein the alternative wire infeed system is designated generally by the reference numeral 160. The same base plate 10 may be used in this embodiment as was used in the previously described embodiment of the wire infeed system. A column 161 is fastened to the base plate 10. There are two bearing blocks 162 and 163 bolted to column 161 by means of bolts such as the one marked 164. A shaft 165 is journaled in bearing blocks 162 and 163 and is retained against axial movement by means of collars such as the one marked 166 and which is clamped to shaft 165. The motor 98 may be the same as the one which is similarly identified in the FIG. 5 embodiment although the motor in the FIG. 11 embodiment may have a higher horse power rating. The chain drive arrangement is in a housing 94 as shown in FIG. 11 and is the same as the chain drive system depicted in FIG. 5. Motor 98 is still controlled by controller 127 and the controller, as in the previously discussed embodiment, responds to signals from potentiometer 66 by adjusting the motor speed in correlation with the amount which the carriage 24 is elevated. The upper and lower pulley sets 45 and 35 function in the same manner and so does the dancer pulley 73 as is suggested in FIGS. 14 and 15.

Referring to FIGS. 10 and 11 again, there is a groove pulley 170 whose hub 171 is keyed on shaft 165. An idler pulley 172 is mounted for rotating freely on a stub shaft 173 which is fixed in a short column 174. The column is mounted to the base 10 by means of a clamping arrangement 175. Idler pulley 172 is in vertical alignment with pulley 170 whose function is to pull the wire from the source of wire such as the barrel 150 or the reel 154 or some other source which is not shown. When shaft 165 turns, the wire drawing pulley 170 turns with it to effect drawing of wire. As is evident in FIGS. 10, 11, 14 and 15, the wire leading from the source passes over the idler pulley 172 and then over wire drawing wheel or pulley 170 from which the wire extends to the dancer pulley 73.

Figure 13:
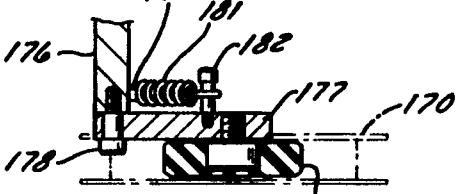
FIG. 13 is a horizontal section of the parts comprising the subassembly depicted in FIG. 12.

As shown in FIG. 11 particularly well, there is a bracket 176 bolted to column 161 for extending horizontally toward wire drawing wheel or pulley 170. As can be seen in any of FIGS. 10–13, a lever 177 is pivotally connected at 178 to bracket 176. A roller 179 is journaled for rotation at the outer end of lever 177. As shown in FIG. 13, roller 179 is preferably composed of a plastic material which offers some resiliency and is journaled for rotation by reason of the roller being formed in concentricity with a bearing element which rotates on a stem that is screwed into lever 177. Roller 179, as shown in FIG. 11, exerts a compressive force on the wire as it passes over pulley or wheel 170 as a result of the lever being biased by a spring 181 which has one end 182 connected to lever 177 and another end which is anchored to a machine screw 183 that is turned into bracket 176. Roller 179 enhances the frictional grip exerted by the wheel 170 on the wire so that there is no slippage between wheel 170 and the wire. A handle 184 is attached to lever 177 to facilitate swinging the lever and wheel 179 out of the way of laying the wire over wheel 170 during the initial setup of the machine.

Although a preferred embodiment of the new prefeeder has been described in detail, such description is intended to be illustrative rather than limiting, for the invention may be variously implemented and is to be limited only by interpreting the claims which follow.

I claim:

1. A wire prefeeder comprising a base and a wire infeed device for feeding wire, support means on said base and an upper shaft mounted to said support means at a fixed distance above the base for the axis of the shaft to extend horizontally, a plurality of upper pulleys arranged on said upper shaft for rotating about the axis of the shaft, a carriage and guide means for guiding said carriage to move up from a lower limit position and back toward said lower limit position, a lower shaft mounted to said carriage with the lower shaft axis extending horizontally in parallelism with the upper shaft, a plurality of lower pulleys arranged coaxially on said lower shaft for rotating about the axis of the lower shaft to provide for storage of a predetermined amount of wire by looping wire fed from said wire infeed device back and forth over said upper and lower pulleys with the wire being drawn from said prefeeder departing at a place of tangency on one of the pulleys, said carriage responding to tension changes in the wire being drawn from said one pulley, due to increases and decreases in the rate at which the wire is drawn from the prefeeder relative to a predetermined rate, by said carriage moving respectively upwardly from said lower limit and downwardly to positions relative to said lower limit representative of the rate at which wire is being drawn and of the change in the amount of wire in storage between said upper and lower plurality of pulleys, a variable speed electric motor mounted to said base, said wire infeed device including a driven shaft and means for coupling said motor to the driven shaft for driving the wire infeed device to effect feeding of wire, means for generating an electric signal whose magnitude is proportional to distance said carriage is moved up from said lower limit position, and a motor controller responsive to said signal by adjusting the motor speed such that wire fed from said wire infeed device to said pulleys for storage is feed at a rate which results in nullifying said tension changes in the wire so as to maintain the rate and tension of the wire drawn from the prefeeder constant, an elongated vertical guide means arranged between said wire infeed device and a vertical plane along which said upper and lower shaft axes lie, a dancer pulley support member mounted for sliding up from a lower limit on said vertical guide means until stopped at an upper limit, and a dancer pulley mounted on said support member for rotating about a substantially horizontal axis to provide for wire being fed from said wire infeed device to be looped under said dancer pulley before the wire runs to one of said upper pulleys with the length of the wire between said wire infeed device and said upper pulleys being sufficient for said dancer pulley support member to remain at its lower limit when wire is not being drawn from the prefeeder, said dancer pulley being pulled up until stopped at its said upper limit in response to wire being drawn from the prefeeder.

2. The prefeeder according to claim 1 including:

a first switch in a circuit with said motor controller and operated when said carriage begins to move up from its lower limit position, a second switch connected in series with said first switch in said circuit and operated when said dancer pulley begins to be pulled up, said motor controller being enabled to start said motor to drive said driven shaft of said wire infeed device for feeding wire from said device when said first and second switches are both operated.

3. The wire prefeeder according to claim 1 wherein said wire infeed device includes:

means for locking a wire reel to said driven shaft.

4. The wire prefeeder according to claim 1 wherein said wire infeed device includes:

a wheel member fixed on said driven shaft for rotation with the driven shaft and arranged for said wire from a source to run on said wheel member for advancing said wire to said pulleys when said motor is driving said driven shaft, a roller mounted for rotating about an axis parallel to said driven shaft and means for urging the periphery of the roller against the periphery of said wheel member for enhancing the frictional grip of said wheel member relative to said wire.

5. The device according to claim 4 including an idler pulley mounted for rotating in proximity with said wheel member about an axis parallel to the axis of said driven shaft, said idler pulley being positioned such that wire supplied to the wire infeed device runs on the idler pulley and leaves the idler pulley to meet the wheel member at a point of tangency which results in increasing the distance along the wire which is in contact with said wheel member from the point of tangency where the wire first contacts said wheel member to the point where said wire departs tangentially from the wheel member for increasing the frictional pulling force between the wheel member and the wire.

6. The prefeeder according to claim 1 wherein said wire infeed device includes clamping means for clamping a reel onto the driven shaft, comprising:

a compressible spring means on said driven shaft, a rear cone element having an axial bore for sliding on said driven shaft and reacting against said spring means to provide for said rear cone to project into one end of the bore of a wire dispensing reel placed on said driven shaft with said cone backed up by said spring, a clamping assembly including a front cone having a base, a truncated apex and an axial bore for fitting on said driven shaft for the apex of the front cone to project into the opposite end of the bore of the wire reel, a cylindrical adjustment member contiguous with said front cone and having a bore coaxial with the said bore in the front cone, said bore in the cylindrical adjustment member having an internal thread, a screw member comprised of a cylindrical body having a bore for fitting on said driven shaft, said body having an external thread screwed into said internal thread in said adjustment member, a clamping device fastened to said screw member and operable to clamp said screw member to said reel when said screw member is screwed into said adjustment member such that when said adjustment member is turned in a direction tending to screw it off said screw members it forces said front cone into engagement with the bore of said reel for being driven rotationally by the driven shaft.

* * * * *